US006093372A

United States Patent [19]

Wallace et al.

[11] Patent Number: 6,093,372

[45] Date of Patent: Jul. 25, 2000

[54] OXYGEN FLOW CONTROL FOR GASIFICATION

[75] Inventors: Paul S. Wallace, Katy; Kay A. Johnson, Missouri City; Delome D. Fair, Friendswood, all of Tex.

[73] Assignee: Texaco Inc., White Plains, N.Y.

[21] Appl. No.: 09/092,629

[22] Filed: Jun. 5, 1998

Related U.S. Application Data

[60] Provisional application No. 60/048,834, Jun. 6, 1997.

[51] Int. Cl.[7] ..... C10J 3/50

[52] U.S. Cl. ..... 422/111; 422/110; 422/115; 48/190; 48/197 R

[58] Field of Search ..... 422/105, 108, 422/110–113, 114, 62; 48/192, 191, 190, 175, 170, 127.9, DIG. 10

[56] References Cited

U.S. PATENT DOCUMENTS

| | | | |
|---|---|---|---|
| 2,809,104 | 10/1957 | Strasser et al. | 48/215 |
| 2,818,326 | 12/1957 | Eastman et al. | 48/196 |
| 2,928,460 | 3/1960 | Eastman et al. | 122/6.5 |
| 3,166,381 | 1/1965 | Loss | 422/62 |
| 3,506,376 | 4/1970 | Dangauthier | 417/14 |
| 3,544,291 | 12/1970 | Schlinger et al. | 48/206 |
| 3,737,252 | 6/1973 | Pilarczyk et al. | 417/53 |
| 3,860,363 | 1/1975 | Silvern et al. | 417/12 |
| 4,060,339 | 11/1977 | Raff et al. | 417/2 |
| 4,146,370 | 3/1979 | Herwijnen et al. | 48/210 |
| 4,158,552 | 6/1979 | Blaskowski et al. | 48/210 |
| 4,217,243 | 8/1980 | Christie | 502/6 |
| 4,270,884 | 6/1981 | Lintonbon et al. | 417/15 |
| 4,273,514 | 6/1981 | Shore et al. | 417/15 |
| 4,328,006 | 5/1982 | Muenger | 48/62 R |
| 4,328,008 | 5/1982 | Muenger et al. | 48/197 R |
| 4,392,347 | 7/1983 | Shows | 60/39 |
| 4,456,546 | 6/1984 | Van der Burgt | 252/373 |
| 4,489,562 | 12/1984 | Synder et al. | 60/667 |
| 4,515,515 | 5/1985 | Segonne | 417/26 |

(List continued on next page.)

FOREIGN PATENT DOCUMENTS

| | | |
|---|---|---|
| 2 401 982 | 6/1978 | France . |
| 58-007363 | 1/1983 | Japan . |
| 59-246038 | 11/1984 | Japan . |
| 60-226794 | 10/1985 | Japan . |
| 61-084121 | 4/1986 | Japan . |
| 61-134763 | 6/1986 | Japan . |
| 3-329997 | 11/1991 | Japan . |
| WO 94/16210 | 7/1994 | WIPO . |

OTHER PUBLICATIONS

PCT Search Report PCT/US98/12063.

*Primary Examiner*—Marian C. Knode
*Assistant Examiner*—Susan Ohorodnik
*Attorney, Agent, or Firm*—Henry H. Gibson; Arnold, White & Durkee

[57] ABSTRACT

The system for controlling oxygen flow in a gasification process of the instant invention comprises a suction control valve located between the oxygen source and the oxygen compressor. The suction control valve is adapted in order to open to deliver oxygen from the source to the compressor through the first pipe and to move to a reduced flow position to prevent excess delivery of oxygen from the source to the compressor. The system also comprises a second pipe which operably connects the oxygen compressor to a port of a gasifier. The system comprises a normally closed vent valve located between the oxygen compressor and the port of a gasifier. The system comprises a means located in the gasifier or in the gasifier effluent for detecting when it is necessary to change the oxygen flow to the gasifier and to actuate the suction control valve sufficient to change the oxygen flow. Finally, the system comprises a means for a means of controlling the suction control valve and the vent valve to regulate the quantity of oxygen delivered to the gasifier.

8 Claims, 2 Drawing Sheets

U.S. PATENT DOCUMENTS

| | | | |
|---|---|---|---|
| 4,531,359 | 7/1985 | Hitzelberger et al. | 60/39 |
| 4,637,823 | 1/1987 | Dach | 48/77 |
| 4,653,677 | 3/1987 | Peters et al. | 222/591 |
| 4,671,806 | 6/1987 | Stil | 95/268 |
| 4,741,674 | 5/1988 | Tischer | 417/295 |
| 4,760,667 | 8/1988 | Eckstein et al. | 48/69 |
| 4,823,741 | 4/1989 | Davis et al. | 122/7 R |
| 4,872,886 | 10/1989 | Henley et al. | 48/197 R |
| 4,889,540 | 12/1989 | Segerstrom et al. | 48/77 |
| 4,891,950 | 1/1990 | Seufert et al. | 62/657 |
| 4,959,080 | 9/1990 | Sternling | 48/210 |
| 4,968,218 | 11/1990 | Koivula et al. | 417/19 |
| 4,979,964 | 12/1990 | Sternling | 48/62 R |
| 5,309,707 | 5/1994 | Provol et al. | 60/39.03 |
| 5,441,990 | 8/1995 | Robin et al. | 518/703 |

OXYGEN FLOW CONTROL FOR GASIFICATION

CROSS REFERENCE TO PATENTS

This application claims priority from U.S. provisional patent application Ser. No. 60/048,834 filed on Jun. 6, 1997, entitled Single Gasifier Train Oxygen & Hydrogen Flow Control System.

FIELD OF THE INVENTION

The instant invention relates to a method and system for controlling the flow of oxygen in a gasification process.

BACKGROUND OF THE INVENTION

Petroleum based feedstocks include impure petroleum coke and other hydrocarbonaceous materials, such as solid carbonaceous waste, residual oils, and byproducts from heavy crude oil. These feedstocks are commonly used for gasification reactions that produce mixtures of hydrogen and carbon monoxide gases, commonly referred to as "synthesis gas" or simply "syngas." Syngas is used as a feedstock for making a host of useful organic compounds and can also be used as a clean fuel to generate power.

The gasification reaction typically involves delivering feedstock, free-oxygen-containing gas and any other materials to a gasification reactor which is also referred to as a "partial oxidation gasifier reactor" or simply a "reactor" or "gasifier." Because of the high temperatures utilized, the gasifier is lined with a refractory material designed to withstand the reaction temperature.

The feedstock and oxygen are intimately mixed and reacted in the gasifier to form syngas. While the reaction will occur over a wide range of temperatures, the reaction temperature which is utilized must be high enough to melt any metals which may be in the feedstock. If the temperature is not high enough, the outlet of the reactor may become blocked with unmelted metals. On the other hand, the temperature must be low enough so that the refractory materials lining the reactor are not damaged.

One way of controlling the temperature of the reaction is by controlling the amount of oxygen which is mixed with and subsequently reacts with the feedstock. In this manner, if it is desired to increase the temperature of the reaction, then the amount of oxygen is increased. On the other hand, if it is desired to decrease and temperature of the reaction, then the amount of oxygen is decreased.

Conventionally, the oxygen to be utilized in the reaction travels via a pipe from an oxygen source to a compressor and then through a second pipe from the compressor to the gasifier. There is often a reservoir between the compressor and the gasifier. At the gasifier, the oxygen is introduced through a port at the upper end of the reactor to mix with the feedstock. Control of the amount of oxygen which enters the port is accomplished by using a valve at the port. When the valve is open, oxygen flows into reactor. When it is necessary to slow the reaction and cool it, for instance, when the flow of feedstock has slowed, then the flow through the valve is reduced, i.e., the valve is moved to a reduced flow position.

Unfortunately, the above-described control system does not control the oxygen very precisely. This is due to the fact that even when the valve at the port is in the reduced flow position, oxygen is still being sent through the second pipe by the compressor. The produced oxygen travels from the compressor to the reduced flow valve and the oxygen pressure increases. Therefore, good control is difficult to achieve.

One solution is to have a large reservoir on the compressor outlet. However, this is a great safety hazard, since there are high temperatures and carbonaceous materials nearby. It would be desirable if a method and system for controlling the flow of oxygen in a gasification process could be discovered which directly reduces the amount of oxygen in the pipeline.

SUMMARY OF THE INVENTION

The system for controlling oxygen flow in a gasification process of the instant invention includes a first pipe which operably connects an oxygen source to an oxygen compressor. A suction control valve is located between the oxygen source and the oxygen compressor. The suction control valve is adapted in order to open to deliver oxygen from the source to the compressor through the first pipe and to move to a reduced flow position to prevent excess delivery of oxygen from the source to the compressor. The system also includes a second pipe which operably connects the oxygen compressor to a port of a gasifier. The system has a normally closed vent valve located between the oxygen compressor and the port of a gasifier. The system contains a means located in the gasifier or in the gasifier effluent for detecting when it is necessary to change the oxygen flow to the gasifier and to actuate the suction control valve sufficient to change the oxygen flow. Finally, the system includes a means for a means of controlling the suction control valve and the vent valve to regulate the quantity of oxygen delivered to the gasifier. The means to detect when it is necessary to reduce or increase oxygen flow to a gasifier may be a hydrocarbon flow measurement device, a thermocouple, a pyrometer, a gas detector, or a gasifier effluent flow meter.

DETAILED DESCRIPTION OF THE INVENTION

Figure 1:
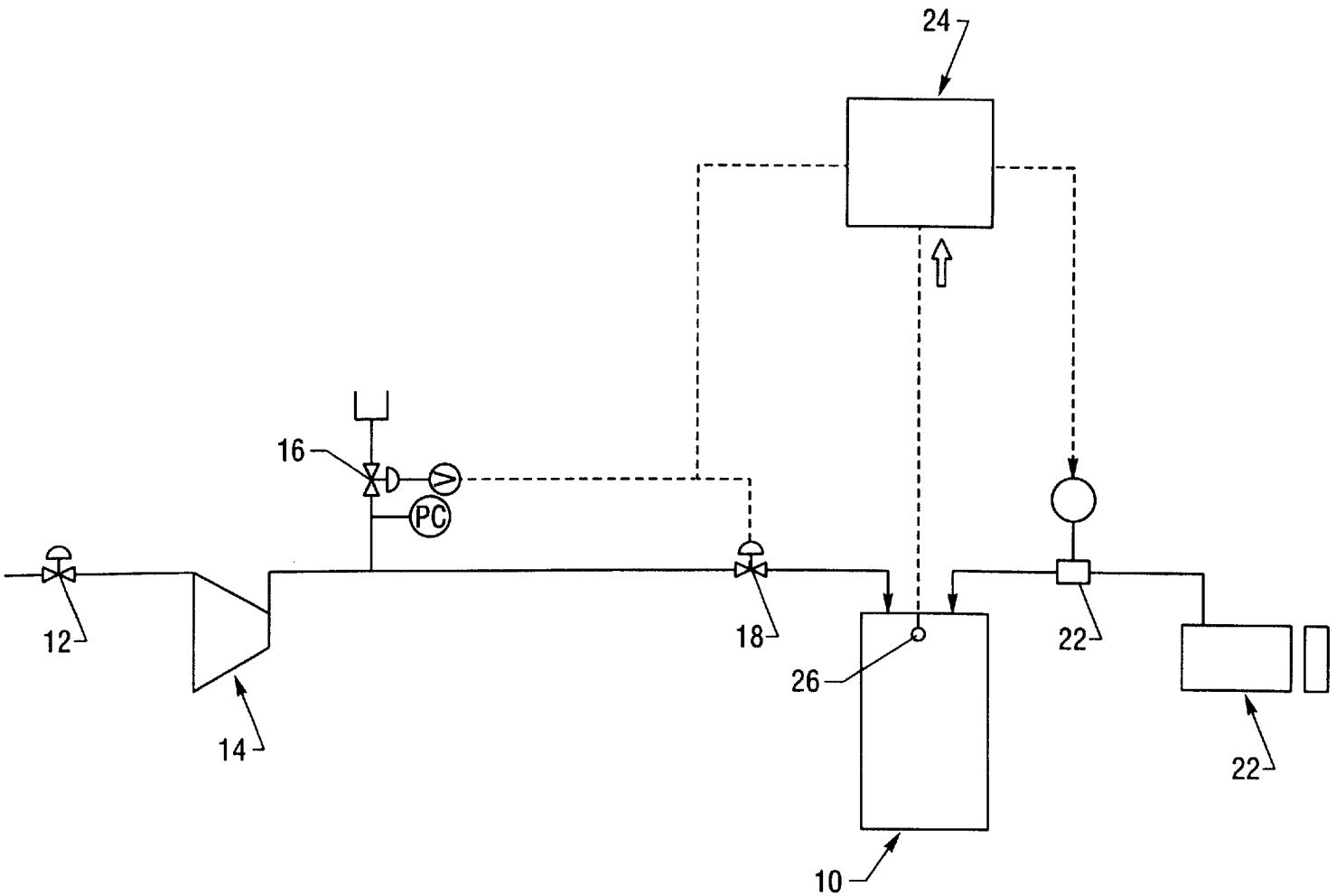
FIG. 1 shows a schematic diagram of an oxygen flow control system of the present invention utilized upon a single gasifier.

As used herein, the term "oxygen compressor" means any device capable of producing oxygen at elevated pressure, say, greater than about 1 atmosphere, or 101 KPa, pressure, suitable for use in gasification.

As used herein, the term "oxygen source" means any device, apparatus, or source which provides oxygen, substantially pure oxygen, or oxygen enriched air having greater than about 21 mole percent oxygen. Any free-oxygen-containing gas that contains oxygen in a form suitable for reaction during the gasification process can be used. Substantially pure oxygen is a gas that contains more than about 90 mole percent, more often about 95 to about 99.5 mole percent oxygen. Commonly, the free-oxygen-containing gas contains oxygen plus other gases derived from the air from which oxygen was prepared, such as nitrogen, argon or other inert gases. A typical oxygen source includes an air separation unit which separates oxygen from air. Such units are commercially available.

As used herein, "suction control valve" means a movable part which is located in the line between an oxygen source and oxygen compressor. The suction control valve allows oxygen to travel through a pipe which is operably connected from the oxygen source to the oxygen compressor when said valve is partially or fully "open". When said valve is "closed", oxygen is prevented from entering the compressor. When said valve is in "reduced flow position", the valve is partially open which reduces the oxygen flow to the compressor as compared to a fully "open" valve. Suction control valves are advantageously continuously adjustable from an open position, through numerous "reduced flow positions", and finally to a closed position.

As used herein, the term "vent valve" refers to a valve that when open allows the gas, in this case oxygen, substantially pure oxygen, or oxygen enriched gas, to exit the pipe and be vented to atmosphere, or to a tank, or to a process wherein the oxygen can be used, or to another location. Where the oxygen is vented to is not important The term "normally closed vent valve" means that the vent valve is closed during normal, steady operation. It is not important to this invention if the valve fail position is open or closed. The vent valve is often advantageously modulating, with an open, a closed, and numerous partially open valve positions.

This present invention is useful for controlling oxygen flow into a reactor in which hydrocarbon feedstock and oxygen react to form syngas. Any effective means can be used to feed the feedstock into the reactor. Generally, the feedstock, oxygen, and any other materials are added through one or more inlets or openings in the reactor. Typically, the feedstock and gas are passed to a fuel injector which is located in the reactor inlet. Any effective fuel injector design can be used to assist the addition or interaction of feedstock and gas in the reactor, such as an annulus-type fuel injector described in U.S. Pat. No. 2,928,460 to Eastman et al., U.S. Pat. No. 4,328,006 to Muenger et al. or U.S. Pat. No. 4,328,008 to Muenger et al which are incorporated herein by reference.

Alternatively, the feedstock can be introduced into the upper end of the reactor through a port. Free-oxygen-containing gas is typically introduced at high velocity into the reactor through either the fuel injector or a separate port which discharges the oxygen gas directly into the feedstock stream. By this arrangement the charge materials are intimately mixed within the reaction zone and the oxygen gas stream is prevented from directly impinging on and damaging the reactor walls.

Any reactor design effective for gasification may be employed. Typically, a vertical, cylindrically shaped steel pressure vessel can be used. Illustrative reactors and related apparatus are disclosed in U.S. Pat. No. 2,809,104 to Strasser et al., U.S. Pat. No. 2,818,326 to Eastman et al., U.S. Pat. No. 3,544,291 to Schlinger et al., U.S. Pat. No. 4,637,823 to Dach, U.S. Pat. No. 4,653,677 to Peters et al., U.S. Pat. No. 4,872,886 to Henley et al., U.S. Pat. No. 4,456,546 to Van der Berg, U.S. Pat. No. 4,671,806 to Stil et al., U.S. Pat. No. 4,760,667 to Eckstein et al., U.S. Pat. No. 4,146,370 to van Herwijner et al., U.S. Pat. No. 4,823,741 to Davis et al., U.S. Pat. No. 4,889,540 Segerstrom et al., U.S. Pat. No. 4,959,080 to Sternling, and U.S. Pat. No. 4,979,964 to Sternling which are incorporated herein by reference. The reaction zone preferably comprises a downflowing, free-flow, refractory-lined chamber with a centrally located inlet at the top and an axially aligned outlet in the bottom.

The gasification reaction is conducted under reaction conditions which are sufficient to convert a desired amount of feedstock to syngas. Reaction temperatures typically range from about 900° C. to about 2,000° C., preferably from about 1,200° C. to about 1,500° C. Pressures typically range from about 1 to about 250 atmospheres, preferably from about 10 to about 150 atmospheres. The average residence time in the reaction zone generally ranges from about 0.5 to about 20, and normally from about 1 to about 10, seconds.

Any free-oxygen-containing gas that contains oxygen in a form suitable for reaction during the gasification process can be used. Typically, the oxygen is prepared by separating oxygen from air via an air separation unit. From the air separation unit, the oxygen travels via a pipe to a compressor which increases the pressure of the oxygen and delivers the oxygen through a second pipe to a port of the upper end of the gasifier.

The optimum proportions of petroleum based feedstock to free-oxygen-containing gas, as well as any optional components, may vary widely with such factors as the type of feedstock, type of oxygen, as well as equipment specification for such items as refractory materials and reactor. Typically, the atomic ratio of oxygen in the free-oxygen-containing gas to carbon, in the feedstock, is about 0.6 to about 1.6, preferably about 0.8 to about 1.4. When the free-oxygen-containing gas is substantially pure oxygen, the atomic ratio can be about 0.7 to about 1.5, preferably about 0.9. When the oxygen-containing gas is air, the ratio can be about 0.8 to about 1.6, preferably about 1.3.

The oxygen flow control system of the present invention may be employed no matter what the optimum proportions of petroleum based feedstock to free-oxygen-containing gas. The oxygen flow control system detects when it is necessary to reduce oxygen flow due to a decrease in hydrocarbon flow. Similarly, the oxygen flow control system detects when it is necessary to increase oxygen flow due to an increase in hydrocarbon flow. Such detectors are readily available commercially. These include hydrocarbon flow meters, thermocouples, velocity meters, pyrometers, gas sensors, or other detecting and measuring devices.

Once a need to reduce oxygen flow is detected, a signal is sent to the suction control valve to move to a reduced flow position or to close, which minimizes or totally prevents oxygen flow into the compressor. The signal may be sent by any signaling means, for instance, a ratio controller such as those commercially available from a number of sources may be employed.

When increased oxygen flow is needed again, a signal is sent to the suction control valve to partially or fully open which increases oxygen flow into the compressor and increases the compressor output. This signal may be sent by the same device that sent the prior signal to close the suction control valve or a second signaling means. In this manner, oxygen flow may be controlled to within 3, preferably 2, more preferably 1 percent of the desired amount.

To maintain quick response to changes in the sensor, there is advantageously no oxygen reservoir, surge tank, or drum at the outlet of the compressor. Similarly, the piping length between the compressor and the inlet of the gasifier is kept to a minimum, preferably less than 2000 feet.

While it is not usually necessary to use the conventional modulating shutoff valve located at the port of the reactor and a compressor discharge valve once the gasification reaction has begun, it may be desirable to use them in conjunction with the present inventive system. In this manner, the flow of oxygen may be reduced by at least 10, preferably at least 15, more preferably at least 20 percent of total oxygen per second when low hydrocarbon flow occurs.

When oxygen flow cannot be reduced fast enough by reducing flow to the compressor, for instance when a gasifier shuts down due to an operational malfunction, a vent valve may be opened. The oxygen flows to the atmosphere or other low pressure application more readily than to the gasifier, thereby reducing oxygen flow to the gasifier. This is especially critical when one or more gasifiers is operating from a single oxygen compressor. The vent valve may be opened rapidly so that no significant change (<1%) in oxygen pressure will occur when all oxygen is rapidly (<5 seconds) cutoff to a gasifier in a multiple gasifier system.

When more than one gasifier is operating from a single oxygen compressor and one gasifier malfunctions, the vent valve at the malfunctioning gasifier opens as the control valve to the malfunctioning gasifier closes. This operation allows a significant amount of oxygen flow from the compressor to the non-malfunctioning gasifiers to continue. Furthermore, due to mechanical limitations of the compressor, reduced flow might cause the compressor to fail and/or cause serious damage to the compressor. A compressor failure would cause the non-malfunctioning gasifier to shut down. Therefore, the ability of the flow control system to vent oxygen to the atmosphere when oxygen flow to a gasifier is interrupted is often critical when gasifiers are sharing a common oxygen compressor.

The oxygen flow control system described herein may be utilized for controlling the flow of oxygen to two or more gasifiers which share a common oxygen source and oxygen compressor. This may be accomplished by, for example, utilizing the system shown in FIG. 2.

Use of the oxygen flow control system of the instant invention allows the flow of oxygen to the gasifier to be controlled to within 1%. The flow of oxygen to the gasifier can be reduced rapidly when low feedstock flow occurs (up to 20%/sec) without causing a significant change (<1%) in oxygen pressure using a modulating shutoff valve and vent valve in conjunction when low fuel flow occurs. The system may also be configured to reduce the fuel flow rapidly (up to 10% per sec) when low oxygen flow occurs. These actions maintain a constant oxygen/hydrocarbon ratio to the gasifier.

FIG. 1 shows a schematic diagram of an oxygen flow control system of the present invention utilized upon a single gasifier. Oxygen containing gas enters from a source such as an air separation unit (not shown) and passed through a suction control valve (12) to the air compressor (14). Compressed gas exits the compressor through a pipe to the gasifier (10). There is a vent valve (16) located on this pipe. There is also an optional modulating valve (18) at the port of the gasifier. Inside the gasifier (10) is a detector (26) capable of detecting when it is necessary to change the oxygen flow to the gasifier and to actuate the suction control valve (12) sufficient to change the oxygen flow. In this embodiment, the carbonaceous fuel source (22) and fuel flow controller (22) are depicted. The controlling means (24) compares fuel input into the reactor (10) and the output of the detector (26) inside the gasifier, and, if the process becomes sufficiently out of balance, the controlling means (24) can close the optional modulating valve (18) and open the vent valve (16). This will quickly reduce the gas flow to the gasifier (10) before the suction control valve (12) is closed.

Figure 2:
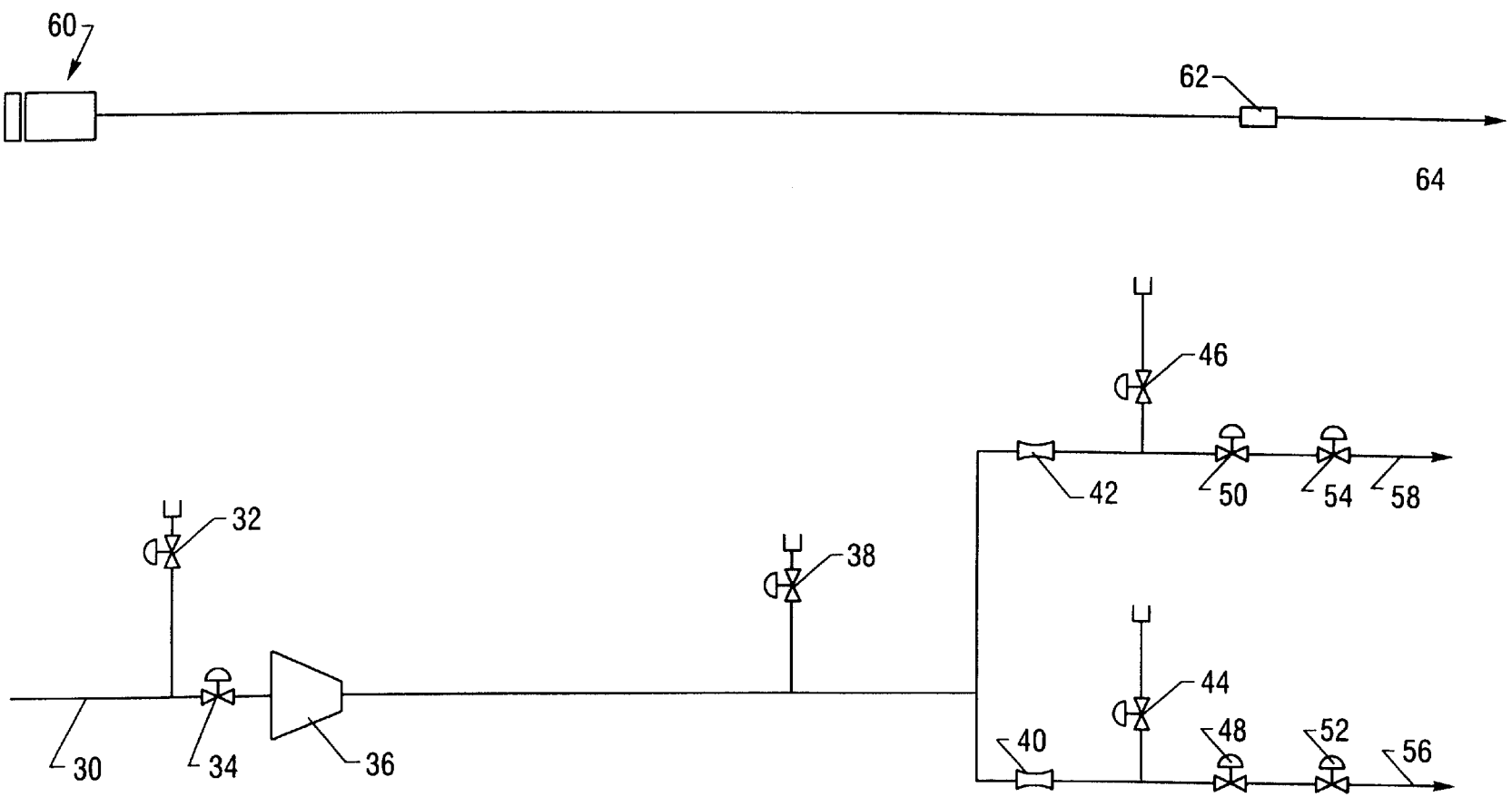
FIG. 2 shows a schematic diagram of an oxygen flow control system of the present invention utilized upon multiple gasifiers (not shown) sharing a common oxygen compressor (36) wherein each gasifier operates independently.

FIG. 2 shows a schematic diagram of an oxygen flow control system of the present invention utilized upon multiple gasifiers (not shown) sharing a common oxygen compressor (36) wherein each gasifier operates independently. Oxygen-containing gas comes from an air separation unit (not shown) via connecting pipe (30). The oxygen containing gas must pass through the suction control valve (34) to the inlet of the compressor (36). A vent valve (32) is installed on connecting pipe (30) to divert low pressure oxygen-containing gas in the event the compressor is inoperable or if the suction control valve is fully closed. The oxygen-containing gas is compressed in the compressor (36), and the output is split to go to two or more gasifiers. There is a high capacity vent valve (38) on the line before the compressed gas is split. After the split, there is a flow measuring device on each line (40 and 42). There is then a second vent valve on each line (44 and 46). This is the vent valve that acts as needed in cooperation with the modulating valves on each line (48 and 50) to quickly reduce oxygen flow to the gasifiers (not shown) when necessary. Alternatively, the functions of vent valve (32) and the vent valves (44 and 46) can be reversed. Primary control of oxygen requirements for the system of all compressors is done with the suction control valve (34), and the modulating valves (48 and 50) apportion gas flow to the individual gasifiers. There are also backup shut-off valves in each of the lines going to the gasifiers (56 and 58), since modulating valves valves (48 and 50) are often not reliable for completely stopping flow. After gas passes through these shut-off valves (52 and 54), the gas enters the gasifiers (not shown) through connecting means (56 and 58). FIG. 2 also shows the fuel flow to one of the gasifiers, where the source of the carbonaceous fuel (60) sends the fuel as a slurry to flow measuring device (62) and then to a gasifier. The rate of gas conveyed to an individual gasifier is dependent on the rate of fuel flow to the gasifier (from 62) and on the output of a detector (not shown) in the gasifier or gasifier effluent that detects whether there is a surplus or shortage off oxygen in the reactor.

EXAMPLE 1

A gasifier is operated in a partial oxidation mode. The reactor is equipped with a pyrometer and thermocouples, not shown, to monitor reactor temperature at the top, middle and bottom of the reaction chamber.

The oxygen is controlled via an oxygen flow control system which is shown in detail in FIG. 1. The gasification reaction is conducted at temperatures of from about 1200° C. (2192° F.) to about 1500° C. (2732° F.) and at pressures of from about 10 to about 200 atmospheres. The feedstock reacts with the gas in the gasifier making synthesis gas and by-products. Synthesis gas and fluid by-products leave the reactor to enter a cooling chamber or vessel, not shown, for further processing and recovery.

Use of the oxygen flow control system of FIG. 1 allows the flow of oxygen to the gasifier to be controlled to within 1%. The flow of oxygen to the gasifier can be reduced rapidly when low feedstock flow occurs (up to 20%/sec) without causing a significant change (<1%) in oxygen pressure using a modulating shutoff valve and vent valve in conjunction when low slurry flow occurs. The system may also be configured to reduce the slurry flow rapidly (up to 10% per sec) when low oxygen flow occurs. These actions maintain a constant oxygen/hydrocarbon ratio to the gasifier. There is no surge drum or pressure control valve necessary and there is minimal piping length (<2000 ft) between the oxygen compressor and the gasifier.

EXAMPLE 2

Two partial oxidation gasifiers are operated in a partial oxidation mode as shown in FIG. 2. The reactors are equipped with a pyrometer and thermocouples, not shown, to monitor reactor temperature at the top, middle and bottom of the reaction chamber.

Free-oxygen-containing gas is fed from a compressor (36). The process of operating two partial oxidation reactors in parallel uses the system that is shown in FIG. 2. Note that the two gasifiers share a common air separation unit and compressor. The partial oxidation reaction is conducted at temperatures of from about 1200° C. (2192° F.) to about 1500° C. (2732° F.) and at pressures of from about 10 to about 200 atmospheres. The feedstock reacts with the gas in the gasifiers (not shown) making synthesis gas and by-products. Synthesis gas and fluid by-products leave the gasifier to enter a cooling chamber or vessel, not shown, for further processing and recovery.

Use of the oxygen flow control system of FIG. 2 allows the flow of oxygen to the gasifier to be controlled to within 1%. The flow of oxygen to the gasifier can be reduced rapidly when low feedstock flow occurs (up to 20%/sec) without causing a significant change (<1%) in oxygen pressure using a modulating shutoff valve (48 and 50) and vent valve (44 and 46) in conjunction when low slurry flow occurs. The system may also be configured to reduce the slurry flow (62) rapidly (up to 10% per sec) when low oxygen flow occurs. These actions maintain a constant oxygen/hydrocarbon ratio to the gasifier. There is no surge drum or pressure control valve necessary and there is minimal piping length (<2000 ft) between the oxygen compressor and the gasifier. In addition, the vent valve (38) may be opened rapidly so that no significant change (<1%) in oxygen pressure will occur when all oxygen is rapidly (<5 seconds) cutoff to one gasifier.

What is claimed is:

1. A system for controlling oxygen flow in a gasification process comprising:

(a) a first pipe which operably connects an oxygen source to an oxygen compressor;

(b) a suction control valve located between the oxygen source and the oxygen compressor, said suction control valve being adapted to open to deliver oxygen from the source to the compressor through said first pipe and to move to a reduced flow position to reduce delivery of oxygen from the source to the compressor;

(c) at least two second pipes which operably connect the oxygen compressor to inlet ports of at least two gasifiers said gasifiers further comprising a fuel feed and an effluent port;

(d) a modulating valve on each of the second pipes, said valves modulating adapted to regulate flow of oxygen to the Gasifiers from the second pipes;

(e) a vent valve located between the oxygen compressor and the modulating valve on each of the second pipes;

(f) a detector located in each gasifier, gasifier fuel feed, or gasifier effluent, said detector adapted to detect insufficient or excess oxygen flow to the gasifier and adapted to actuate the suction control valve; and (g) a first actuator adapted to control the suction control valve and a second actuator adapted to control the vent valve, wherein the suction control valve and the vent valve are adapted to regulate the quantity of oxygen delivered to each gasifier.

2. The system of claim 1 which further comprises a modulating valve at the port of the gasifier adapted to regulate flow of oxygen to the gasifier from the second pipe.

3. The system of claim 1 wherein the detector is selected from the group consisting of a thermocouple, a pyrometer, and an effluent gas velocity sensor.

4. The system of claim 1 wherein the detector is a pyrometer.

5. The system of claim 1 wherein the length of each of the second pipes is less than 2000 feet.

6. The system of claim 5 wherein the second pipe is not operatively connected to a surge tank.

7. A method of controlling oxygen flow in a gasification process using the apparatus of claim 1, said method comprising a) determining the oxygen requirements in each of a plurality of gasifiers, said oxygen requirements determined from the detectors adapted to detect insufficient or excess oxygen in the gasifiers, said detectors located in each gasifier, gasifier fuel feed, or gasifier effluent, (b) providing a gas comprising molecular oxygen to a first pipe which operably connects an oxygen source to an oxygen compressor;

(c) providing a suction control valve located on the first pipe between the oxygen source and the oxygen compressor, (d) actuating said suction control valve, said suction control valve being adapted to open to increase oxygen flow from the source to the compressor through said first pipe when the detectors indicate the amount of oxygen in the gasifiers is insufficient, and to move to a reduced flow position to reduce delivery of oxygen from the source to the compressor when the detectors indicate the amount of oxygen in the gasifiers is in excess;

(e) conveying the compressed gas in a plurality of second pipes to the plurality of gasifiers, wherein each second pipe operably connects the compressor to a gasifier;

(f) providing a modulating valve on each of the said second pipes, said modulating valve being adapted to open to increase oxygen flow from the compressor through said second pipe when the detector indicates the amount of oxygen in said gasifier is insufficient, and being adapted to move to a reduced flow position to reduce delivery of oxygen from the compressor through said second pipe to the gasifier when the detector indicates the amount of oxygen in the gasifier is in excess;

(g) actuating said modulating valve for a gasifier in response to the detector output from said gasifier, (h) providing a vent valve located between the oxygen compressor and the modulating valves on the plurality second pipes, wherein each vent valve is opened if the detector indicates the oxygen flow to the gasifier is more than 2% above the predetermined quantity.

8. The method of claim 7 wherein the differential pressure across each modulating valve is 280 KPa or less.

* * * * *